US006203382B1

(12) United States Patent
Frisby

(10) Patent No.: US 6,203,382 B1
(45) Date of Patent: Mar. 20, 2001

(54) CONNECTOR FOR BATTERY TERMINAL POST

(75) Inventor: Reginald Alan Frisby, Stoke on Trent (GB)

(73) Assignee: Leoni Wiring Systems UK Limited, London (GB)

( * ) Notice: Subject to any disclaimer, the term of this patent is extended or adjusted under 35 U.S.C. 154(b) by 0 days.

(21) Appl. No.: 09/331,625

(22) PCT Filed: Jan. 26, 1998

(86) PCT No.: PCT/GB98/00218

§ 371 Date: Aug. 12, 1999

§ 102(e) Date: Aug. 12, 1999

(87) PCT Pub. No.: WO98/34299

PCT Pub. Date: Aug. 6, 1998

(30) Foreign Application Priority Data

Jan. 31, 1997 (GB) ..... 9702008

(51) Int. Cl.[7] ..... H01R 4/38
(52) U.S. Cl. ..... 439/757; 439/759
(58) Field of Search ..... 439/757, 759, 439/760, 817, 819

(56) References Cited

U.S. PATENT DOCUMENTS

| | | | | |
|---|---|---|---|---|
| 2,470,104 | * | 5/1949 | Martin . | |
| 5,346,407 | * | 9/1994 | Hood | 439/522 |
| 5,861,223 | * | 1/1999 | Montlagh | 429/121 |

FOREIGN PATENT DOCUMENTS

| | | |
|---|---|---|
| 641 618 | 9/1993 | (AU) . |
| 39 42 241 | 6/1991 | (DE) . |
| 0374 342 | 6/1990 | (EP) . |

* cited by examiner

*Primary Examiner*—Neil Abrams
*Assistant Examiner*—Javaid Nasri
(74) *Attorney, Agent, or Firm*—Wells, St. John, Roberts, Gregory &n Matkin, P.S.

(57) ABSTRACT

A battery terminal post connector having first and second clamp components shaped to receive and grip a battery terminal post under the action of a resilient compression spring which urges the clamp components towards one another to grip the post. The connector also includes a release element which is moveable relative to the components and which, during such movement, cooperates with at least one of the components to provide a camming action driving the components apart against the action of the spring so as to release the grip of the components on the post in use.

10 Claims, 2 Drawing Sheets

CONNECTOR FOR BATTERY TERMINAL POST

BACKGROUND OF THE INVENTION

This invention relates to an electrical connector for engagement with a terminal post of an electrical storage battery.

Conventional battery terminal posts are formed from lead or an alloy thereof and project from the top surface of the battery casing. The posts are of circular cross-section, and usually taper from a maximum diameter adjacent the battery lid to a minimum at their free end. A variety of connectors for such terminal posts are known. There are some connectors which are simply a push fit onto the post and others which employ a two-part collar the two parts being clamped around the post to grip the post. European Patent No. 0374342 shows an arrangement where a two-part collar is clamped by an over centre linkage arrangement which is relatively difficult and therefore expensive to fabricate, and is prone to wear resulting in loss of clamping force.

German Patent Application No. 3445736 illustrates an arrangement where the collar is clamped around the terminal post solely by spring force. The arrangement is considerably more simple, and therefore potentially less expensive than that illustrated in European Patent No. 0374342, and is advantageous in that it can simply be push fitted onto the terminal post. However, the connector of German Patent Application No. 3445736 is extremely difficult to remove, requiring the introduction of a levering tool, or possibly disassembly of the connector to relieve the spring load.

It is an object of the present invention to provide a battery terminal post connector in a simple and convenient form wherein the aforementioned disadvantages are minimised or obviated.

SUMMARY OF THE INVENTION

In accordance with the present invention there is provided a battery terminal post connector comprising first and second clamp components shaped to receive between them, and to grip, a battery terminal post in use, resilient means acting to urge the first and second components to move to grip the post in use, a release element moveable relative to said components and cooperating with at least one of the components to provide a camming action for moving said components against said resilient means to release the grip of the components on the post in use.

Preferably said first and second components are carried in a housing member and said resilient means acts between the housing member and said first component to urge the first component towards the second component to provide the gripping action in use.

Conveniently said release element is pivotally connected to said housing member and has a camming cooperation with said first component whereby movement of the release element relative to the housing member moves said first clamp component relative to said second clamp component in a direction against the action of said resilient means.

Desirably said resilient means is a helical compression spring.

Preferably said release element defines a cam surface which is engaged by a cam follower of the first clamp component.

Preferably said release element is so arranged that it can be gripped when the connector is in position on a battery terminal in such a way that lifting movement in a direction to attempt to lift the connector from the terminal provides the release action thereafter continued lifting movement detaches the connector from the terminal.

Desirably the connector includes a cover within which said components and said release element are housed, said cover being coupled to said release element.

BRIEF DESCRIPTION OF THE DRAWINGS

One example of the invention is illustrated in the accompanying drawings, wherein.

DETAILED DESCRIPTION OF THE PREFERRED EMBODIMENT

Figure 1:
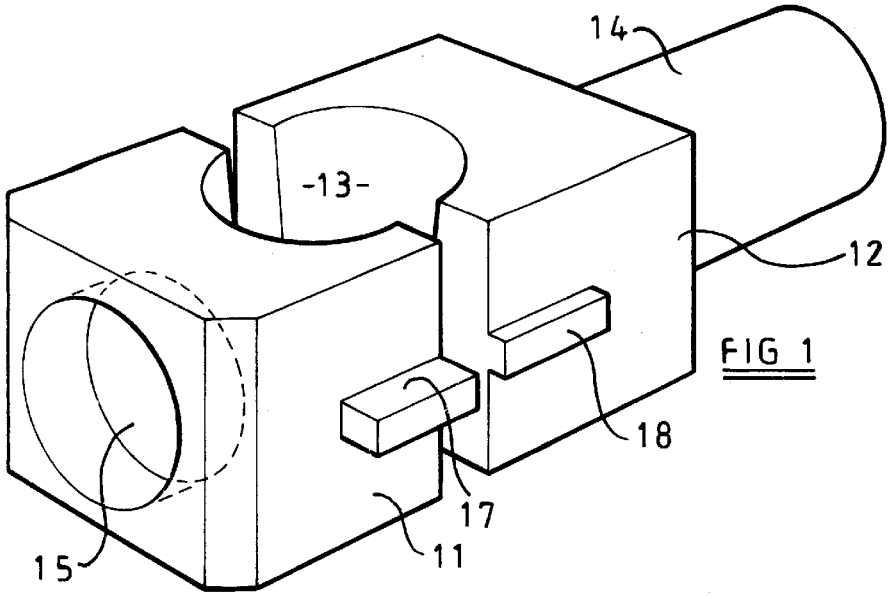
FIG. 1 is a diagrammatic perspective view of the first and second clamp components of a battery terminal post connector.
Figure 2:
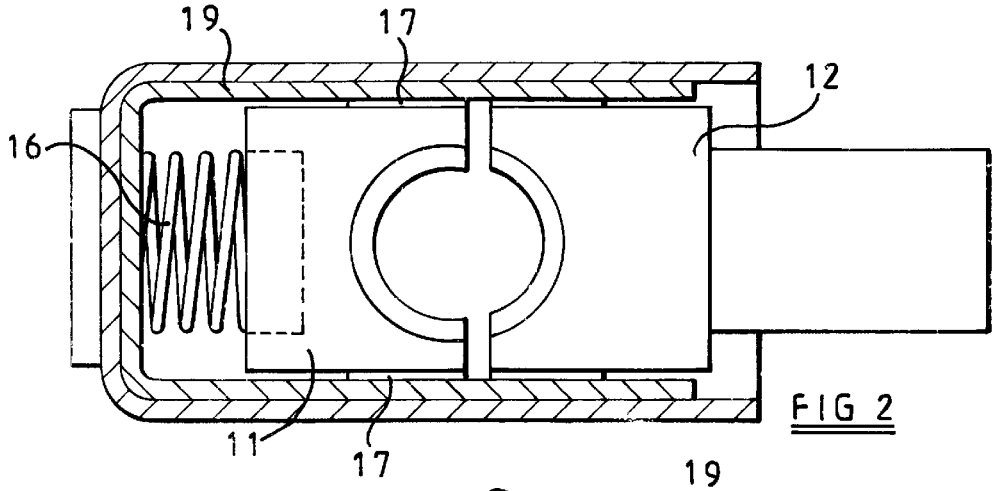
FIG. 2 is an inverted plan view of the connector.
Figure 3:
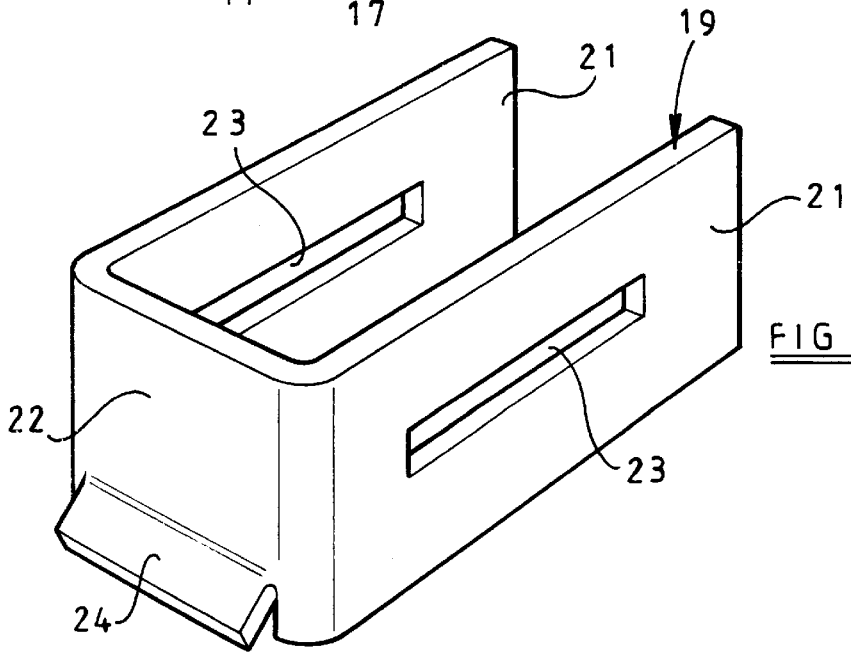
FIG. 3 is a perspective view of a housing member of the connector.
Figure 4:
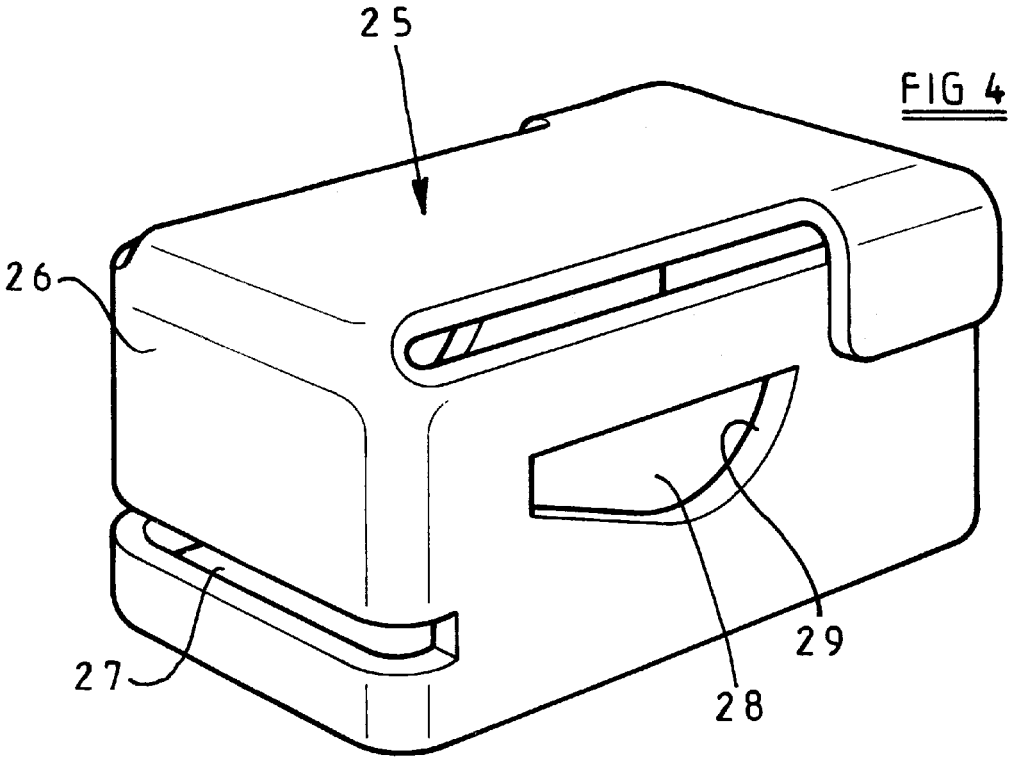
FIG. 4 is a perspective view of a release element of the connector.

Referring to the drawings, the connector comprises first and second clamping components or jaws 11, 12 which are formed from a suitable metal, conveniently brass or copper. The jaws are generally in the form of rectangular blocks, and their mutually presented faces are recessed to define between them a passage 13 conforming to the shape of a battery terminal post. The jaw 12 is formed at its end remote from the jaw 11 with an integral sleeve 14 for receiving, and connecting to, a conductive lead. The end of the jaw 11 remote from the jaw 12 is recessed at 15 to form a seating for one end of a helical compression spring 16 (FIG. 2). The jaw 11 is formed with first and second identical lugs 17 protruding from opposite side walls respectively, and the jaw 12 is formed with similar lugs 18 also projecting from its side walls, and arranged coplanar with the lugs 17. The extent of the projection of the lugs 18 is less than that of the lugs 17.

A U-shaped housing member 19 is formed from a length of metal strip, conveniently mild-steel, and receives the jaws 11, 12 between its parallel limbs 21, with the jaw 11 adjacent the base wall 22 of the member. The limbs 21 are formed with longitudinally extending rectilinear slots 23 for receiving the lugs 17, 18. The lugs 17 protrude completely through the slots 23, but the height of the lugs 18 is such that they terminate flush with the outer surface of the limbs 21 of the member 19. The length of the slots 23 is greater than the combined length of the lugs 17, 18 when the jaws 11, 12 are in abutting relationship. If desired the free ends of the limbs 21 can be chamfered or flared outwardly to provide a lead for the lugs 17,18 during assembly of the member 19 over the jaws 11,12.

The helical compression spring 16, or if desired a conical spring, a resilient rubber or synthetic resin block or other convenient resilient element or elements, acts between the base of the recess 15 in the jaw 11 and the inner surface of the end wall 22 of the member 19 and thus urges the jaw 11 towards the jaw 12, and urges both jaws to move longitudinally relative to the member 19 until the ends of the lugs 18 abut the ends of the slots 23 remote from the base wall 22. The shaping of the recesses in the abutting faces of the jaws 11, 12 which define the passage 13 are such that the jaws 11, 12 do not touch one another when a post is received between them, and thus the spring 16 acting directly on the jaw 11, and acting on the jaw 12 through the housing member 19, urges the jaws towards one another so that the terminal post is gripped in the passage 13.

The connector further includes a release element 25 which is of box-like construction being formed from shaped and folded metal sheet, conveniently mild-steel. The release element 25 has an end wall 26 formed with a transverse slot 27, and the assembly of jaws 11, 12 and housing member 19 is received within the box-like release element 25 such that an outwardly turned integral flange 24 along one edge of the base wall 22 of the housing member 19 protrudes through the slot 27. The end of the release element 25 remote from the end wall 26 is open so that the sleeve 14 of the jaw 12 can protrude therefrom, and the lower face of the release element 25 which is presented to the battery lid in use is also open.

The opposite side walls of the release element 25 are formed with respective shaped slots 28 for receiving the portions of the lugs 17 of the jaw 11 which protrude through the slots 23 of the housing member 19. The upper edge of each of the slots 28 lies generally parallel to the length of the element 25 but the lower walls of the slots 28 extend at an angle so that the slots 28 are wedge-shaped having their narrower ends adjacent the end wall 26 of the element 25. The opposite end walls 29 of the slots 28 define arcuate cam surfaces which can cooperate with cam followers defined by the lugs 17. It will be recognised from the following description that the shaping of the end walls 29 of the slot 28 can be other than arcuate. For example, inclined rectilinear surfaces could provide an appropriate cam action.

The engagement of the flange 24 in the slot 27 provides a hinge connection between the element 25 and the member 19 the range of pivotal movement of which is controlled by engagement of the lugs 17 with the upper and lower edges of the slots 28. Within the permitted range of arcuate movement of the element 25 relative to the member 19 the end walls 29 of the slots 28 act as cam surfaces cooperating with the lugs 17 which act as cam followers. The shape of the walls 29 is such that as the element 25 is hinged upwardly relative to the member 19, so that the lower surfaces of the slots 28 are moved towards the lugs 17, the slot end walls 29 coact with the lugs 17 to move the jaw 11 against the action of the spring 16. Thus lifting movement of the element 25 releases the clamping action of the jaws 11, 12 about the terminal post in use freeing the connector from the terminal post so that the connector can simply be lifted off the terminal post.

A moulded synthetic resin cover 31, open at its lower face, receives the assembly of jaws 11, 12, housing member 19, and release element 25, the housing 31 being anchored in any convenient manner to the release element 25. The cover 31 is electrically insulating, and is also coloured and carries indicia, related to the function of the connector. The cover 31 is shaped, at least adjacent its end remote from the hinge connection between the element 25 and the housing member 19, to facilitate manual gripping of the cover 31. It will be recognised that the connector can be engaged with a terminal post simply by locating the passage 19 on the terminal post and pushing the connector towards the battery lid. The taper of the terminal post and passage 13 will allow the terminal post to enter between the jaws 11, 12 driving the jaws apart against the action of the spring 16. Thereafter the spring 16 provides the gripping force by which the jaws grip the terminal post.

In order to remove the connector from the terminal post it is simply necessary to grip the cover 31 and lift it upwardly as if pulling the connector from the terminal post. The lifting action on the cover 31 will hinge the element 25 relative to the member 19 thus camming the jaw 11 against the action of the spring 16 and releasing the grip of the jaws 11, 12 about the post. Thereafter the continued lifting movement applied by the user to the connector will simply lift the connector from the terminal post. It will be recognised that the positive camming action driving the jaw 11 away from the jaw 12 will also assist in overcoming any sticking due to corrosion which might have arisen between the jaws 11, 12 and the terminal post in use.

By virtue of the arrangement it will be perceived by the user that removal of the connector from the terminal post is simply the opposite of fitting even though during removal the camming action occurs to release the clamping force.

Figure 5:
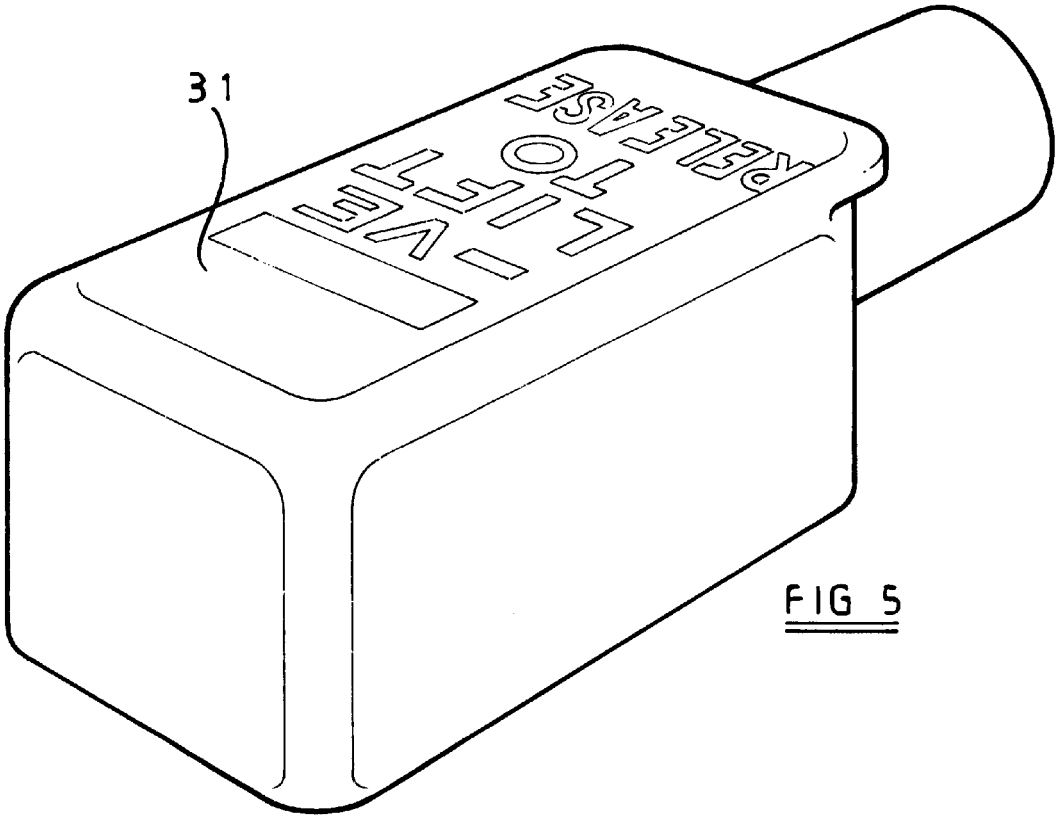
FIG. 5 is a perspective view of an external cover member of the connector.

It will be recognised that instead of manufacturing the release element 25 and cover 31 as separate components, it may be more convenient and cost effective to combine the release element with the cover 31. Such a component may have the same external appearance as the cover 31 shown in FIG. 5 but would incorporate the hinge connection with the member 19 and the cam surfaces 29 as internal features of the moulding. It may however be desirable to incorporate metal inserts in the moulding of such a combined component to provide the cam surfaces 29 cooperating with the lugs 17.

It will be understood that other forms of hinge connection between the cover 31, release element 25, and the housing member 19 could be provided if desired.

What is claimed is:

1. A battery terminal post connector comprising:

first and second clamp components shaped to receive between them, and to grip, a battery terminal post in use;

at least one resilient element arranged to urge the first and second components to move to grip the post in use; and a release element moveable relative to both said clamp components and cooperable with at least one of the clamp components to provide a camming action for moving said at least one of the clamp components against said at least one resilient element to release the grip of the components on the post in use.

2. A connector as claimed in claim 1, wherein said first and second components are carried in a housing member and said resilient element acts between the housing member and said first component to urge the first component towards the second component to provide the gripping action in use.

3. A connector as claimed in claim 2, wherein said release element is pivotally connected to said housing member and has a camming cooperation with said first component whereby movement of the release element relative to the housing member moves said first clamp component relative to said second clamp component in a direction against the action of said resilient element.

4. A connector as claimed in claim 3, where said resilient element is a helical compression spring.

5. A connector as claimed in claim 3, wherein said release element defines a cam surface which is engaged by a cam follower of the first clamp component.

6. A connector as claimed in claim 3, wherein said release element is so arranged that it can be gripped when the connector is in position on a battery terminal in such a way that lifting movement in a direction to attempt to lift the connector from the terminal provides the release action thereafter continued lifting movement detaches the connector from the terminal.

7. A connector as claimed in claim 1, wherein said release element is so arranged that it can be gripped when the connector is in position on a battery terminal in such a way that lifting movement in a direction to attempt to lift the connector from the terminal provides the release action thereafter continued lifting movement detaches the connector from the terminal.

8. A connector as claimed in claim 1, including a cover within which the release element and components are housed, said cover being coupled to said release element grip of the components on the post in use.

9. A battery terminal post connector comprising:

first and second clamp components having respective faces shaped to receive between them, and to grip, a battery terminal post in use, the first clamp component having first and second sides, and lugs protruding from each of the first and second sides, the second clamp component having first and second sides, and lugs protruding from each of the first and second sides of the second clamp component;

a housing member having parallel limbs, and including slots configured to guide the lugs protruding from the first and second sides of the first and second clamp components for movement of the faces of the first and second clamp components toward and away from one another, the lugs of the first clamp component extending out further from the first and second sides of the first clamp component than the lugs of the second clamp component, such that lugs of the first clamp component protrude through the slots of the parallel limbs but the lugs of the second clamp component do not protrude through the slots of the parallel limbs;

at least one resilient element arranged between the housing member and one of the clamp components to urge the first and second components to move to grip the post in use; and a release element pivotally moveable relative to the housing member and moveable relative to both said clamp components and including first and second opposite slots that respectively have surfaces cooperable with the protruding lugs of the first clamp component to provide a camming action for moving said first clamp component against said at least one resilient element to release the grip of the components on the post in use.

10. A battery terminal post connector comprising:

first and second clamp components shaped to receive between them, and to grip, a battery terminal post in use;

at least one resilient element arranged to urge the first and second components to move to grip the post in use;

a housing member carrying said first and second components, said resilient element acting between the housing member and said first component to urge the first component towards the second component to provide the gripping action in use; and a release element moveable relative to both said clamp components and pivotally connected to said housing member, the release element having a camming cooperation with said first clamp component wherein pivotal movement of the release element relative to the housing member moves said first clamp component relative to said second clamp component in a direction against the action of said resilient element.

* * * * *